United States Patent [19]

Terao

[11] 4,214,433

[45] Jul. 29, 1980

[54] CALENDAR DISPLAY APPARATUS

[75] Inventor: Hiroyuki Terao, Kodaira, Japan

[73] Assignee: Casio Computer Co., Ltd., Tokyo, Japan

[21] Appl. No.: 889,203

[22] Filed: Mar. 23, 1978

[30] Foreign Application Priority Data

Mar. 30, 1977 [JP] Japan ..... 52-35690

[51] Int. Cl.[2] ..... G04B 19/24; G04B 19/30

[52] U.S. Cl. ..... 368/28; 340/756; 368/82; 368/232

[58] Field of Search ..... 58/4 R, 4 A, 5, 23 R, 58/58, 50 R; 340/324 M, 336; 350/330, 332; 40/107

[56] References Cited

U.S. PATENT DOCUMENTS

| | | | |
|---|---|---|---|
| Re. 29,250 | 6/1977 | Tanaka | 58/58 |
| 3,276,198 | 10/1966 | Barbera | 58/4 A |
| 3,464,200 | 9/1969 | Merrick | 58/58 |
| 3,810,322 | 5/1974 | Ritchie | 58/4 A |

OTHER PUBLICATIONS

Funkschall, 17/535, 1975, pp. 101–103.

*Primary Examiner*—Vit W. Miska

*Attorney, Agent, or Firm*—Frishauf, Holtz, Goodman & Woodward

[57] ABSTRACT

A calendar display apparatus comprising a calendar display panel device indicating the 1st to 31st days constituting at least one month which are arranged in a plurality of rows and columns in conformity to the serial order of the seven days of the week, wherein the calendar display panel device is supplied according to a referential clock pulse signal with at least "day" data and "month" data. A column data producing device is provided for specifying that column of the calendar on which there falls a particular day of the week in the month indicated by the "month" data. A column-specifying device receives column data delivered from the column data producing device for designating that column of the calendar in which there falls a particular day of the week. A "month"-shifting instruction generating device shifts month data forward or backward, and a data-shifting device varies the "month" data and also changes the column data supplied to the column-specifying device from the column data producing device.

11 Claims, 13 Drawing Figures

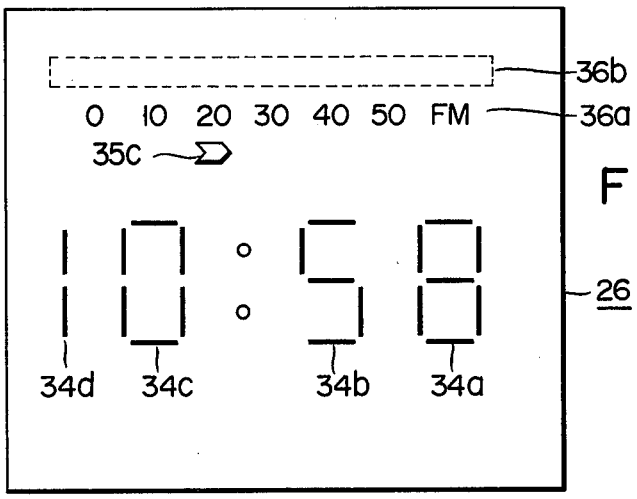
FIG. 6
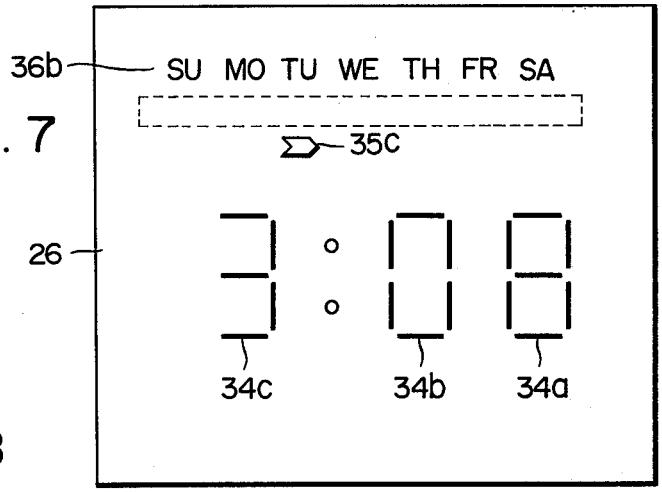
FIG. 7
FIG. 8
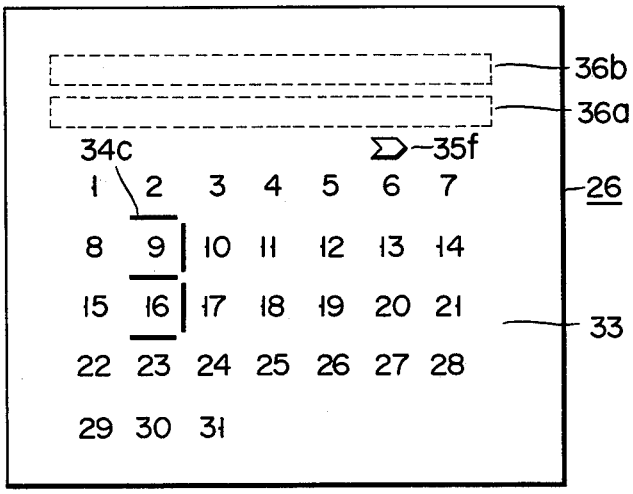

CALENDAR DISPLAY APPARATUS

BACKGROUND OF THE INVENTION

This invention relates to a calendar display apparatus used, for example, with a timepiece for electronically counting momentarily changing points of time, and more particularly to a calendar display apparatus capable of shifting "month" data.

There has already been proposed an electronic wrist watch which counts clock signals issued from, for example, a quartz oscillator, and drives a digital time display section by the counted signals, thereby numerically indicating time. This type of timepiece can easily produce signals denoting "month" and "day" by further counting time signals, thereby digitally displaying data on "month" and "day" in succession by means of a time-displaying device.

The above-mentioned digital timepiece easily indicates a point of time and date by means of a single display device. In the daily routine of work, it is indeed necessary to recognize a data associated therewith. Where, however, various schedules are planned, it often becomes necessary to obtain calendar information showing a particular day of the current month or the preceding or succeeding month in consideration of the corresponding day of the week.

SUMMARY OF THE INVENTION

This invention has been accomplished in view of the above-mentioned circumstances, and is intended to provide a calendar display apparatus which, when used with, for example, a wrist watch, can easily make a calendar display by means of an electronic display device such as a liquid crystal or light-emitting diode and indicate a series of "month" data by shiting them in succession, or carry out the so-called month-shifting operation.

To this end, this invention provides a calendar display apparatus which comprises a calendar display panel device for selectively indicating the 1st to 31st days constituting at least one month, the days being arranged at least in a plurality of columns in conformity to the serial order of the seven days of the week, data signal-generating means for producing according to a referential clock pulse at least date data and month data, column data producing means for producing column data corresponding to a column of a calendar table in which there falls a particular day of the week in the month indicated by the "month" data, column-specifying means for receiving the column data delivered from the column data producing means and designating the column of the calendar table in which there falls the particular day of the week, month-shifting instruction-generating means for shifting month data on the calendar forward or backward, and data-shifting means for changing a column data supplied to the column-specifying means from the column data producing means.

This invention enables a calendar display device constructed as described above to be easily incorporated in a digital display timepiece. The calendar display apparatus of this invention efficiently carries out the calendar display of not only the current month, but also the preceding or succeeding month by the month-shifting operation, offering great advantage in confirming various schedules associated with the daily routine of work.

BRIEF DESCRIPTION OF THE DRAWINGS

FIGS. 6, 7, 8, 9(*a*), 9(*b*), 10(*a*) and 10(*b*) set forth the various modes of display appearing on the display panel.

DETAILED DESCRIPTION

Figure 1:
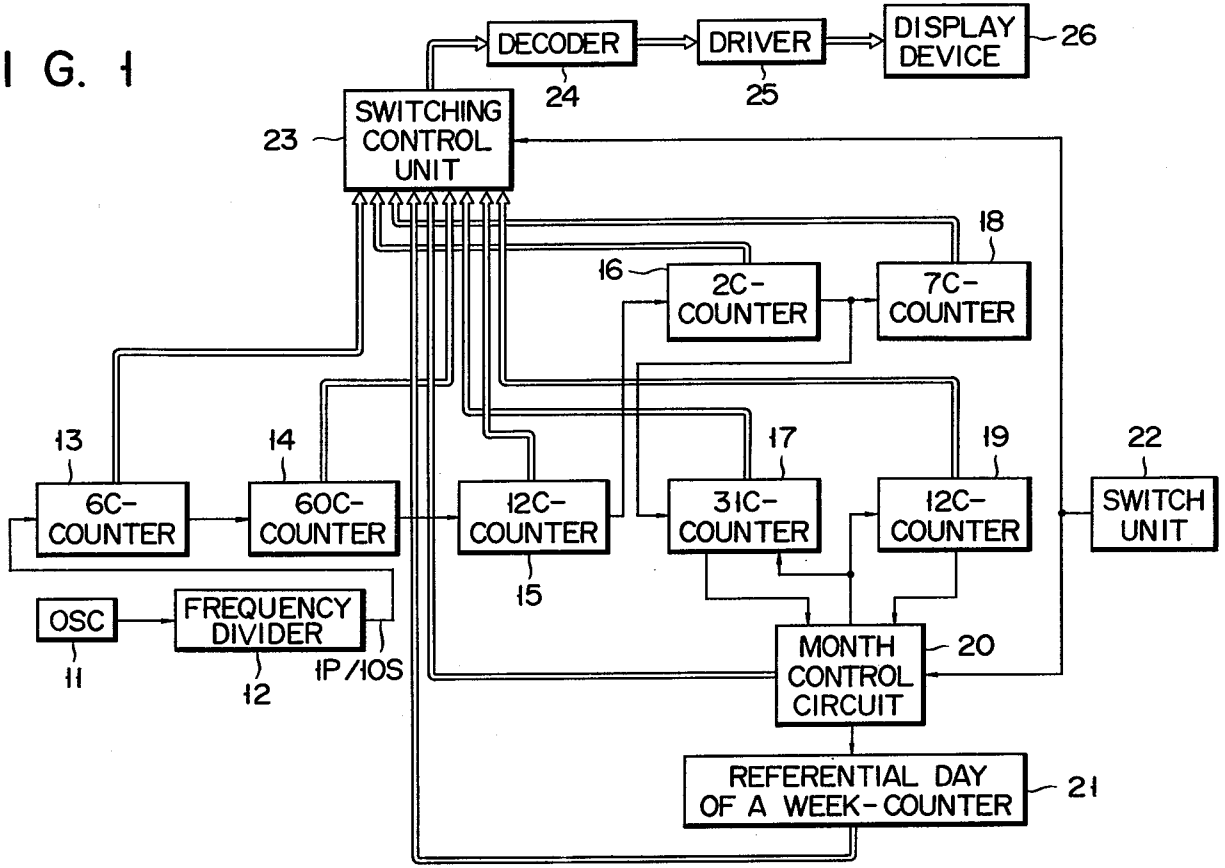
FIG. 1 is a block circuit diagram of a calendar display apparatus embodying this invention.

There will now be described by reference to the accompanying drawings a calendar display apparatus embodying this invention. FIG. 1 indicates the circuit arrangement of a timepiece provided with a calendar display apparatus embodying the invention. The timepiece comprises a referential oscillator 11 such as a quartz oscillator issuing referential clock signals. A referential clock signal issued from the referential oscillator 11 has its frequency divided by a frequency divider 12 to provide a time-counting clock pulse signal issued at an interval of 10 seconds (1 P/10 sec.). This 1 P/10 sec pulse signal advances the count of a 6-scale "second" counter 13. A count made by said "second" counter 13 is used as a time-counting signal indicating a "10-second" unit. The "second" counter 13 sends forth a carry signal for every 60 seconds or every minute, thereby advancing the count of a 60-scale "minute" counter 14, which produces time-counting signals indicating a "minute" unit. This "minute" counter 14 generates a carry signal for every 60 minutes or one hour. The carry signal is supplied as an advance signal to a 12-scale "hour" counter 15. This "hour" counter 15 gives off a time-counting signal indicating an "hour" unit and also a carry signal for every 12 hours. This carry signal is counted by a binary counter 16 to distinguish between the morning (AM) and afternoon (PM). The binary counter 16 sends forth a "day" advance signal for every 24 hours. This "day" advance signal causes a 31-scale "day" counter 17 to count days. Seven days counted by the "day" counter 17 advance the count of a seven-scale "week" counter 18, thus providing a "week" counting signal. A 12-scale "month" counter 19 is provided to correspond to the "day" counter 17. Counts made by both counters 17, 19 are supplied to a month length-defining circuit 20. This month length-defining circuit 20 reads a count made by the "month" counter 19 and judges whether a particular month has 30, 31, 28 or 29 days. Where the "day" counter 17 counts days to indicate the judged month length and has its "day" count ready to be advanced, then a reset signal is issued to the "day" counter 17 to set a day count made by said "day" at "1". On the other hand, the "month" counter 19 has its count advanced by "1". Thus, the shifting of the counted numbers of the months and days is always so controlled as to match what is indicated on a calendar table.

The month length-defining circuit 20 also controls a "weekday" counter 21. Where numerals of "1" to "31" are arranged in a plurality of rows and columns in conformity to the serial order of the seven days of the week, it is necessary to specify that column of the calendar table on which there falls a particular day of the week included in each month. The "weekday" counter 21 stores a numeral representing the serial position ocupied by that column of the calendar table on which there falls, for example, "Sunday" of the current month. Therefore, the "weekday" counter 21 is of the 7-scale type. Where the calendar is shifted from a longer month of 31 days to the succeeding month, and it is desired to find the serial position in said succeeding month of that column of the calendar table on which there falls, for example, "Sunday", then it is advised to add "+4" to the preceding count made by the "weekday" counter 21 as confirmed from the regular shift mode of the calendar. This operation indicates the "Sunday" column of the succeeding month, because said "Sunday" column of the succeeding month is shifted regularly by four columns from the calendar of the preceding month. Where the calendar is shifted from a shorter month of 30 days to the succeeding month, then it is advised to add "+5" to the previous count made by the "weekday" counter 21, because, in this case, the "Sunday" column, for example, is shifted regularly by five columns from the calendar table of the preceding month. Where the calendar is shifted from February of 29 days in the case of a leap year to the succeeding month, then it is advised to add "+6" to the previous count made by the "weekday" counter 21, because, in this case, the "Sunday" column of the succeeding month is shifted regularly by six columns from the calendar table of said February. Where the calendar is shifted from February of 28 days in the case of a common year to March, then the "Sunday" column, for example, in March has the same serial position as in February, making it unnecessary to change the previous count made by the "weekday" counter, because 28 days are divisible by 7 days.

The time counters 13, 14 15 send forth time-counting signals indicating units of "10 seconds", "1 minute" and "1 hour" respectively. The time counter 16 issues signals distinguishing between "AM" and "PM". All these time-counting signals are supplied to a switching control unit 23 whose operation is controlled by a switching unit 22. Under the normal condition in which the switching unit 22 does not issue an instruction, the switching control unit 23 supplies the above-mentioned time-counting signals to a decoder 24. Time is digitally indicated on an electronically actuated display device 26 such as a liquid crystal display device by operating a driver 25.

"Day" signals delivered from the time-counting circuits 17, 18, 19 are conducted to the switching control unit 23. When the switching unit 22 issues a "day" display instruction, the resultant "day" signal is selectively supplied to the decoder 24, thereby indicating "month", "day" or weekday by the time display function of a display device 26.

This display device 26 indicates not only "point of time" and "day", but also a calendar in which the 1st to 31st days are arranged in a plurality of rows and columns in conformity to the serial order of the seven days of the week. Display of this calendar information is effected by an instruction issued from the switching unit 22. The switching control unit 23 detects a count made by the "weekday" counter 21 and specifies that column of the calendar table on which there falls, for example, "Sunday".

Numerals of 1 to 28 are always indicated on the calendar table for the respective months. Numerals of 29 to 31 are selectively used for longer and shorter months and February of a leap year. The length of the respective months is determined by the month length-defining circuit 20 from a count made by the 12 scale "month" counter 19. A count made by the month length-defining circuit 20 is detected when a calendar is displayed, thereby effecting the selective display of "numerals of 29 to 31".

Figure 2:
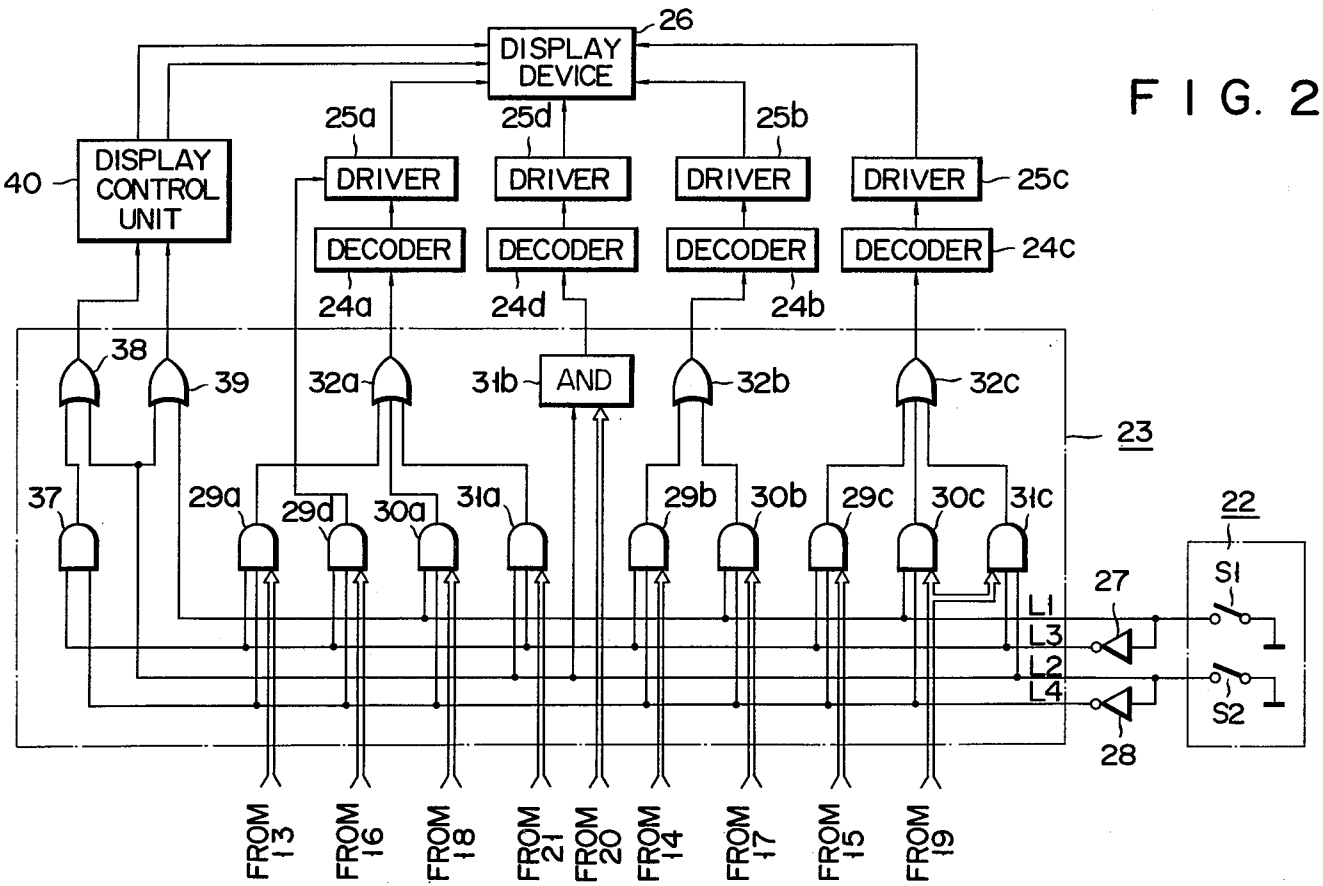
FIG. 2 is a block circuit diagram showing the relative positions of the switching control unit of FIG. 1 and the associated circuits.

FIG. 2 shows in greater detail parts associated with the switching control unit 23. The switching unit 22 comprises switches $S_1$, $S_2$ which, when operated, issue a signal having a logic level of "1". The switches $S_1$, $S_2$ are connected to inverter 27, 28. Signals having a logic level of "1" delivered from the switches $S_1$, $S_2$ when thrown in are conducted to lines $L_1$, $L_2$ respectively. Signals having a logic level of "1" which are obtained from the inverters 27, 28 when the switches $S_1$, $S_2$ are rendered nonconducting are supplied to lines $L_3$, $L_4$ respectively.

The switching control unit 23 comprises AND circuits **29*a* to 29*d*, which are respectively supplied with time-counting signals indicating units of "10 seconds", "1 minute" and "1 hour" and a time-counting signal distinguishing between the AM and PM all issued from the aforesaid time-counting circuits. The switching control unit 23 further comprises AND circuits 30*a* to 30*c* supplied with signals denoting "weekday", "day" and "month". AND circuits 31*a*, 31*b* are supplied with a "weekday" signal and a month length-defining signal. There is further provided an AND circuit 31*c* which is provided with a signal denoting a month displayed on the calendar table. Signals from the AND circuits 29*a*, 30*a*, 31*a* are conducted to an OR circuit 32*a*. Signals from the AND circuits 29*b*, 30*b* are sent forth to an OR circuit 32*b*. Signals from the AND circuits 29*c*, 30*c*, 31*c* are carried to OR circuits 32*a* to 32*c*. Output signals from the OR circuits 32*a* to 32*c* are supplied to decoders 24*a* to 24*c* respectively to actuate the drivers 25*a* to 25*c***.

A calendar display instruction from the AND circuit **31*b* is supplied to the decoder 24*d*, causing a calendar to be indicated on the calendar display section 33 of the display device 26 by operating the driver 25*d***.

Figure 3:
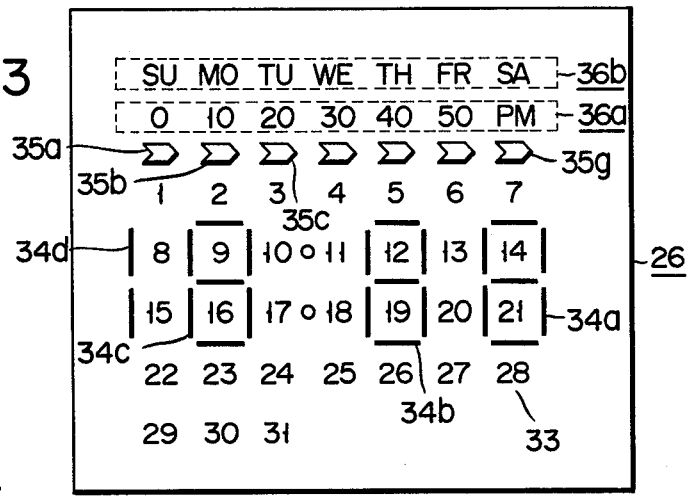
FIG. 3 illustrates the mode in which the display panel of the calendar display apparatus of this invention makes a display.

The display device 26 comprises the display section 33 which indicates, as shown in FIG. 3, numerals of 1 to 31 arranged in a plurality of rows and columns in conformity to the serial order of the seven days of the week, and carries out a display by means of, for example, a liquid crystal. Display segments constituting two 2-digit characters **34*a*–34*b* and 34*c*–34*d* respectively denoting "minute" and "hour" are formed in the spaces lying between the numerals appearing on the calendar display section 33. Seven column-specifying display means 35*a* to 35*g* are provided above the respective columns corresponding to the seven days of the week appearing on the calendar display section 33. Any of these "weekday" column-specifying display means 35*a* to 35*g* is used to specify a particular one of the seven "weekday" columns indicated on the calendar table. Said display means 35*a* to 35*g* also display signals denoting the unit of "10 seconds" and signals distinguishing between the AM and PM. Auxiliary display means 36*a* indicates actual "weekdays" whose serial positions are shown by the display means 35***a* to 35*g*. The driver 25*a* of FIG. 2 causes the display means 35*a* to 35*g* to make required displays. The drivers 25*b*, 25*c* of FIG. 2 causes digits 34*a*–34*b* and 34*c*–34*d* respectively representing "minute" and "hour" to be displayed. An output signal from the AND circuit 29*d* is directly supplied to the driver 25*a* to actuate the display means 35*g*, thereby displaying a signal distinguishing between the AM and PM.

The auxiliary display sections 36*a*, 36*b* select the contents of display to be made by the display device 26. Under the normal condition in which the switches $S_1$, $S_2$ are not operated, the AND circuit 37 detects output signals from the lines $L_3$, $L_4$. The OR circuit 38 issues an instruction to reset the auxiliary display section 36*a*. Where the switch $S_1$ alone is thrown in to issue an instruction for display of a "day" signal, then the OR circuit 39 detects an output signal from the line $L_1$ and issues an instruction to extinguish the auxiliary display section 36*a* for displaying signals indicating the unit of "10 seconds" and signals distinguishing between the AM and PM. Where the switch $S_2$ is rendered conducting to issue an instruction for a calendar display, then the OR circuits 38, 39 issue instructions to extinguish both auxiliary display sections 36*a*, 36*b*. Said instructions are supplied through the driver 40 to stop the display of the auxiliary display sections 36*a*, 36*b*.

Where the switch $S_1$ of the switching unit 22 is thrown in, an output signal from the line 1 is conducted to the AND circuits 30*a* to 30*c* and 31*c*; and an output signal from the line $L_3$ is delivered to the AND circuits 29*a* to 29*d* and 31*a*. Where the switch $S_2$ is operated, an output signal from the line 2 is sent forth to the AND circuits 31*a* to 31*c*, and an output from the line $L_4$ is carried to the AND circuits 29*a* to 29*d*, and 30*a* to 30*c*. Where both switches $S_1$, $S_2$ are left open, time-counting signals are supplied. Where the switch $S_1$ alone is thrown in, a "day" signal is supplied. Where the switch $S_2$ is operated with the switch $S_1$ thrown in, a signal is issued to display the calendar of the current month.

Figure 4:
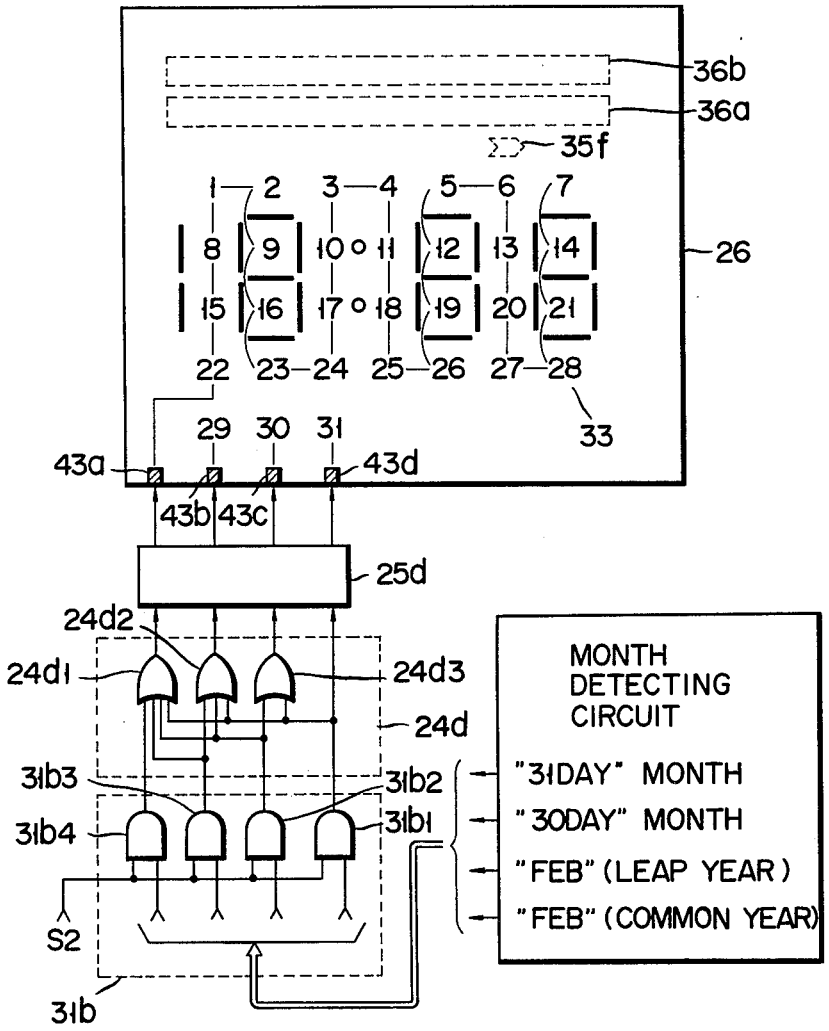
FIG. 4 sets forth a control circuit for controlling the operation of the segmental character electrodes mounted on the display panel embodying the invention.

With the calendar display section 33, numerals of 1 to 31 are arranged in a plurality of rows and columns in conformity to the serial order of the seven days of the week. As mentioned above, the numerals of 29 to 31 must be selectively displayed according to the length of a particular month being displayed. FIG. 4 shows the circuit arrangement of the month length-defining circuit. The AND circuits 31*b* of the switching control unit 23 comprise AND circuits $31b_1$ to $31b_4$ which are supplied with a gate signal when the switch $S_2$ is thrown in. These AND circuits $31b_1$ to $31b_4$ are further supplied with a signal distinguishing between a longer month, shorter month, February of a leap year and February of a common year which is obtained when the month length-defining circuit 20 detects a count made by the 12-scale "month" counter 19. The OR circuit $24d_1$ of the decoder 24 is supplied with output signals from the AND circuits $31b_1$ to $31b_4$. The OR circuit $24d_2$ receives output signals from the AND circuits $31b_1$ to $31b_3$. The OR circuit $24d_3$ is supplied with output signals from the AND circuits $31b_1$, $31b_2$.

With the calendar display section 33, numerals of 1 to 28 are displayed by a common signal sent forth from a terminal 43*a* (FIG. 4). Numerals of 29, 30, 31 are separately displayed by signals delivered from terminals 43*b*, 43*c*, 43*d*. An output signal from the OR circuit $24d_1$ is conducted to the terminal 43*a*. Output signals from the OR circuits $24d_2$, $24d_3$ and AND circuit $31b_1$ are supplied through the driver 25 to the terminals 43*b* to 43*d* respectively.

In the case of a longer month, all the terminals 43*a* to 43*d* are supplied with a drive signal, making a calendar display indicating all the numerals of 1 to 31. In the case of a shorter month, a calendar display is made with numerals 1 to 30 indicated. With February of a leap year, numerals of 1 to 29 appear on a calendar table. With February of a common year, the OR circuit 42*a* along issues are output signal, providing a calendar display including numerals of 1 to 28.

Figure 5:
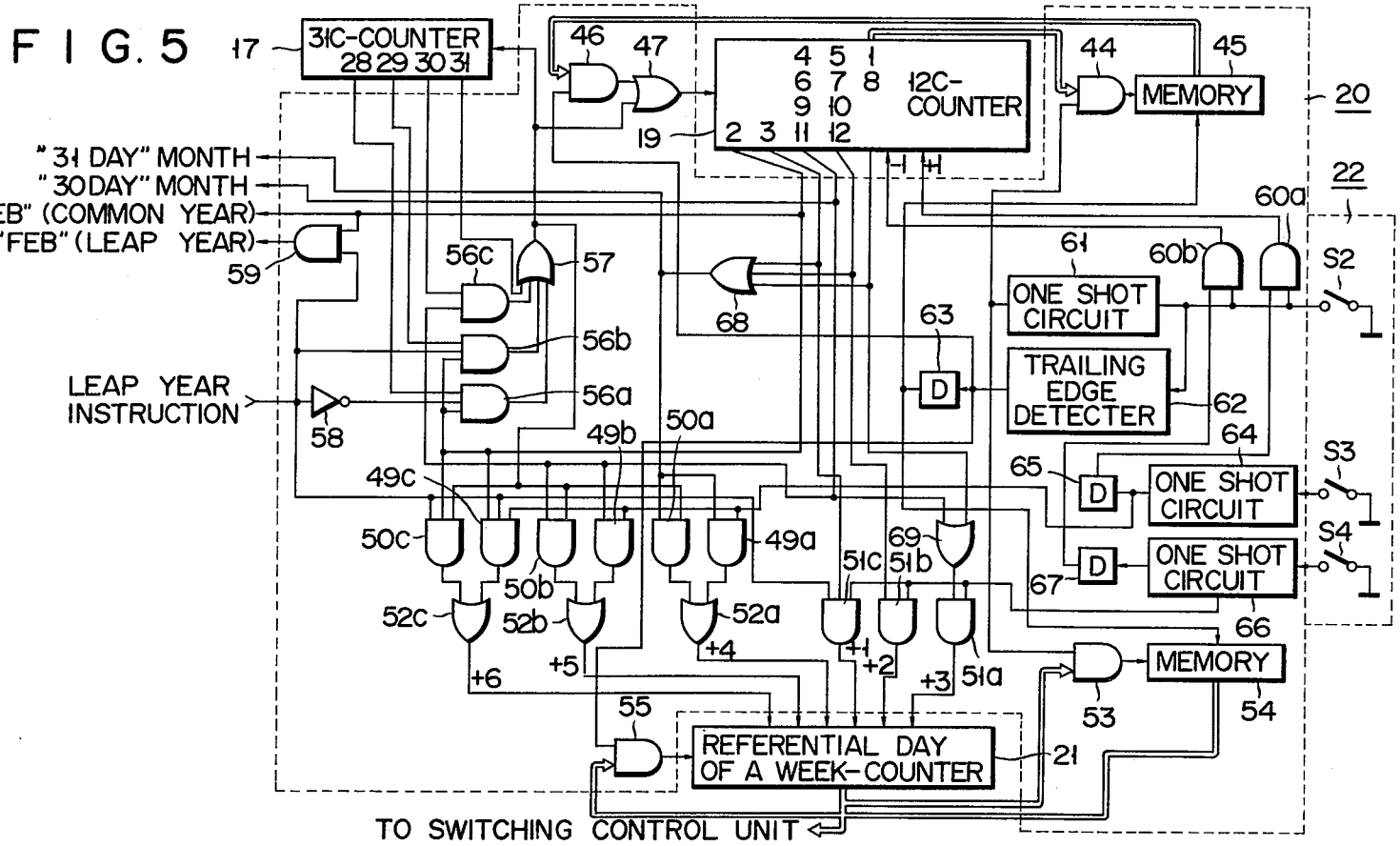
FIG. 5 shows the concrete arrangement of the month length-defining circuit.

FIG. 5 shows the concrete arrangement of the month length-defining circuit 20. When the counting of 28, 29, 30, 31 by the "day" counter 17 is brought to an end, then signals denoting the lengths of the respective months classified as "February of both common and leap years", "March", "April–June–September–November", "May–July–October–December", and "January–August" are supplied to the month length-defining circuit 20 from the "month" counter 19 through its terminals corresponding to the classified groups of months.

Where the "month" counter 19 issues a carry signal per year during a 4-year leap cycle, then a signal instructing the display of a leap year is supplied to the month length-defining circuit 20. Referring to FIG. 5, the switching unit 22 comprises not only the switch $S_2$ used to instruct a calendar display but also a switch $S_3$ used to advance the serial position of the current month of the calendar table and a switch $S_4$ for reversing the serial position of the current month of the calendar table.

Referring to FIG. 5, a count made by the "month" counter 19 is read out to a memory 45 through an AND circuit 44. The contents of said memory 45 is written in the "month" counter 19 through an AND circuit 46 and OR circuit 47. Signals denoting the lengths of the longer months classified as "March", and "May–July–October–December" and "January–August" which are delivered from the corresponding terminals of the "month" counter 19 are sent forth through an OR circuit 68 to AND circuits 49*a*, 50*a*. Signals denoting the lengths of the shorter months classified as "February" and "April–June–September–November" which are issued from the corresponding terminals of the "month" counter 19 are conducted to a group of AND circuits 49*b*, 50*b* and a group of AND circuits 49*c*, 50*c*, respectively.

Signals denoting the lengths of months classified as "January–August" and "April–June–September–November" are supplied to an AND circuit 51*a* through an OR circuit 69. Signals denoting the lengths of months classified as "May–July–October–December" and "March" are carried to AND circuits 51*b*, 51*c* respectively. Output signals from the group of the AND circuits 49*a*–50*a*, the group of the AND circuits 49*b*–50*b* and the group of the AND circuits 49*c*–50*c* are supplied to OR circuits 52*a* to 52*c* respectively. Output signals from the OR circuits 52*a* to 52*c* are supplied to the "weekday" counter 21 as instructions to add "+4", "+5", "+6" respectively to the previously stored contents of said counter 21. Output signals from the AND circuits 51*a* to 51*c* are delivered to said "weekday" counter 21 as instructions to make additions of "+3", "+2" and "+1". This "weekday" counter 21 controls the operation of the aforesaid display sections 35*a* to 35*g* according to a count made by said counter 21, thereby specifying one of the seven "weekday" columns appearing on the calendar display section 33, for example, that column on which "Sunday" falls. A count made by the "weekday" counter 21 is read out through an AND circuit 53 to a memory 54, whose contents are later fed back to said "weekday" counter 21.

Signals denoting numerals of 28, 29 and 30 counted by the "day" counter 17 are carried to AND circuits 56*a* to 56*c*. Output signals from these AND circuits 56*a* to 56*c*, together with a signal denoting a numeral "31" counted by the "day" counter 17, are supplied to an OR circuit 57. An output signal from the OR circuit 57 is delivered as a reset signal to the "day" counter 17 and also to the "month" counter 19 through the OR circuit 47 as an instruction for said counter 19 to advance its month count by one, and further to the AND circuits 50*a* to 50*c* as a gate signal. The AND circuit 56*a* receives a gate signal from an inverter 58 which is supplied with a signal instructing the display of a leap year. This leap year display-instructing signal is conducted as a gate signal to the AND circuits 49*c*, 50*c*, 51*c* and also to an AND circuit 59. An output signal from the AND circuit 59 is used to display February of a leap year on the calender table of the current month. The AND circuits 56*a*, 56*b* are supplied with a signal denoting the length of February of a leap year. The AND circuit 56*c* receives a gate signal indicating the length of said February.

A signal issued upon operation of the switch $S_2$ is supplied as a gate signal to AND circuits 60*a*, 60*b*, and also to a one-shot circuit 61. A one-shot signal which rises upon operation of the switch $S_2$ is conducted as a gate signal to the AND circuits 44, 53, causing the counts made by the "month" counter 19 and "weekday" counter 21 to be read out to the memories 45, 54 respectively. A signal issued from the switch $S_2$ is carried to a rear edge detector 62, and supplied as a gate signal to the AND circuits 46, 55 when the switch $S_2$ is brought back to the original position, causing the contents of the memories 45, 54 to be fed back to the "month" counter 19 and "weekday" counter 21 respectively. An output signal from a delay circuit 63 clears the contents of the memories 45, 54.

The operation of the switch $S_3$ is detected by a one-shot circuit 64. An output signal from this one-shot circuit 64 is delivered to the AND circuits 49*a* to 49*c*, and also to a delay circuit 65. An output signal from this delay circuit 65 is sent forth to the AND circuit 60*a*, an output signal from which is supplied to the "month" counter 19 as an instruction for said counter 19 to advance its month count by "+1".

The operation of the switch $S_4$ is detected by a one-shot circuit 66. An output signal from this one-shot circuit 66 is delivered to a delay circuit 67 and also to the AND circuits 51*a* to 51*c*. An output signal from the delay circuit 67 is conducted to the AND circuit 60*b* and also to the "month" counter 19 as an instruction for said counter 19 to subtract its count by 1.

With the month length-defining circuit 20, the "day" counter 17 counts "days", and the "month" counter 19 counts "months". The "weekday" counter 21 stores the serial position of, for example, the "Sunday" column of the calendar table.

Where the "month" counter 19 generates an instruction resulting from the detection of a longer month as the calendar proceeds, then the "day" counter 17 continues counting up to 31. Where the succeeding advance operation is commenced from this state, a signal is supplied to the OR circuit 57 to reset the "day" counter 17, causing its contents to be set at 1. The "month" counter 19 has its count advanced by one to shift the serial position of the current month of the calendar table. At this time, an output signal from the OR circuit 57 is send forth to the AND circuits 50*a* to 50*c*. Since, at this time, an OR circuit 68 issues a signal denoting the detection of a longer month, an output signal from the AND circuit 50*a* causes the "weekday" counter 21 to have its count increased by "+4" through the OR circuit 52. An output signal from the "weekday" counter 21 instructs the shifting of the serial position of, for example, the "Sunday" column of the calendar table in a month following the 31-days longer month.

Where the "month" counter 19 sends forth a signal denoting the detection of a shorter month, then the AND circuit 56*c* is supplied with a gate signal. When, therefore, the "day" counter 17 counts 30, then the OR circuit 57 sends forth an output signal, which resets the "day" counter 17, rendering the calendar display apparatus ready for the shifting of the current month. An output signal from the AND circuit 50*b* causes the "weekday" counter 21 to have its count increased by "+5", thereby specifying, for example, the serial position of the "Sunday" column of the calendar table of the succeeding month. Where the "month" counter 19 detects the length of February of a common or leap year, the AND circuit 56*a* or 56*b* is selectively gated to indicate 28 or 29 as the length of February. In the case of February of a leap year, an output signal from the AND circuit 50*c* causes the "weekday" counter 21 to have its count increased by "+6", thereby specifying the serial position of, for example, the "Sunday" column appearing on the calender table of February of a leap year.

According to this invention, days are automatically counted by an instruction specifying the length of the respective months. A calendar display is effected by operation of the switch $S_2$. The serial position of that column of the calendar on which a particular day of the week, for example, "Sunday" falls is specified by selective actuation of the weekday column-specifying display means 35*a* to 35*g* upon receipt of a display signal from the "weekday" counter 21.

Operation of the switch $S_2$ of the month length-defining circuit 20 displays the calendar table of the current month. Data on the serial position of the current month as well as on the serial position of that column of the calendar table on which, for example, "Sunday" falls are stored in the memories 45, 54 respectively through the corresponding circuit 44, 53. Since, in this case, the "month" counter 19 and "weekday" counter 21 store data associated with the current month, operation of the switch $S_2$ alone obviously displays the calendar table of the current month.

Where, however, it is desired temporarily to display the calendar table of the following month, it is advised to actuate the switch $S_3$ with the switch $S_2$ kept conducting and issue a one-shot pulse from the one-shot circuit 64. The one-shot pulse is supplied to the AND circuits 49*a* to 49*c*. An instruction is issued to the "weekday" counter 21 while the "month" counter 19 is still counting the length of a given month, causing the "weekday" counter 21 to specify that column of the calendar table of the succeeding month on which a particular day of the week, for example, "Sunday" falls. Now let it be assumed that the current month is April. Since, in this case, there is issued a signal denoting the detection of a shorter month, the AND circuit 49*b* generates an output signal upon issue of a one-shot pulse.

As the result, the "weekday" counter 21 has its count increased by "+5", thereby specifying that column of the calendar table of the succeeding May on which, for example, "Sunday" falls. Later, the AND circuit 60 issues an instruction for the "month" counter 19 to have its count increase by "+1" in response to an output signal from the delay circuit 65. Thereafter each time the switch $S_3$ is thrown in, display is made of the calendar table of a month whose serial position has been advanced.

Where the switch $S_2$ is left open upon completion of a calendar display, the rear edge detector 62 produces an output signal to open the gates of the AND circuits 46, 55. Data on the serial position of the current month stored in the memory 45, and data on the serial position of the column of the calendar table of the current month representing, for example, "Sunday" which is stored in the memory 54 are fed back to the "month" counter 19 and "weekday" counter 21 respectively. As the result, the calendar display section 33 later continues to display the calendar table of the current month or April. At this time, the memories 45, 54 are cleared of the contents by an output signal from the delay circuit 63.

Where it is desired temporarily to display the calendar table of the preceding month, then the switch $S_4$ is operated with the switch $S_2$ thrown in for a calendar display. First, the contents of the "month" counter 19 and "weekday" counter 21 relative to the current month are stored in the memories 45, 54 respectively by operation of the switch $S_2$. Thereafter, one-shot pulses corresponding to the operation of the switch $S_4$ are conducted to the AND circuits 51*a* to 51*c*. While the "month" counter 19 still holds data on the current month, an instruction is given for the "weekday" counter 21 to specify the serial position of that column of the preceding month on which a particular day of the week, for example, "Sunday" falls. Now let it be assumed that the current month is August. Since a signal is kept issued to denote the length of months grouped as "January–August", the AND circuit 51*a* is gated through an OR circuit 69. Upon receipt of a one-shot pulse from the one-shot circuit 66, the AND circuit 51*a* generates a signal which instructs the "weekday" counter 21 to have its count increased by "+3", thereby specifying the serial position of that column of the preceding month or July on which a particular day of the week, for example, "Sunday" falls. Later, the delay circuit 67 sends forth a signal to the AND circuit 60*b*, causing the "month" counter 19 to have its count decreased by "−1" to provide the calendar table of the preceding month or July. Thus the "weekday" counter 21 also has its count corrected in the reverse direction from the case where the calendar table of the current month is shifted to that of the succeeding month, thereby specifying the serial position of that column of the preceding month on which, for example, "Sunday" falls.

As mentioned above, the calendar display apparatus of this invention makes it possible selectively to display the calendar table of a month preceding or following the current month by operation of the switch $S_3$ or $S_4$.

With a timepiece provided with the display device 26 shown in FIG. 3, the auxiliary display section 36*a* of FIG. 6 carries out display under the normal condition where any of the switches of the switching unit 22 is not operated. At this time, therefore, the display reads, for example, as follows:

"10"hr—"58"min—"20"second order

Where the switch $S_1$ alone is thrown in, then the auxiliary display section 36*b* makes a display, which reads for example as follows (FIG. 7):

"3"months—"8"days—"Tu(Tuesday)"

Where the switch $S_2$ is operated, the auxiliary display sections 36*a*, 36*b* do not make a display, as seen from FIG. 8. The calendar display section 33 carries out a display. Thus numerals 1 to 28 (and 29 to 31 depending on the length of the current month) are displayed. Further, the serial position of the current month of the calendar table (for example, "third" or March) is indicated on the numeral display section 34*c* correspondingly to a count made by the "month" counter 19. The "weekday" column-specifying display means 35*f* indicates the serial position of that column of the current month on which, for example, "Sunday" falls.

Figure 9:
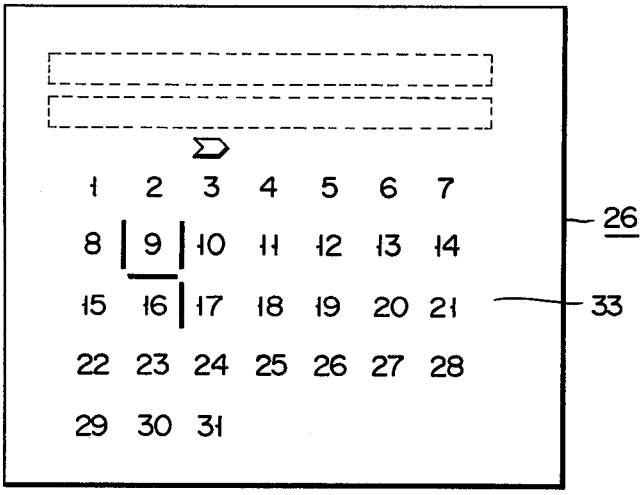
Figure 9:
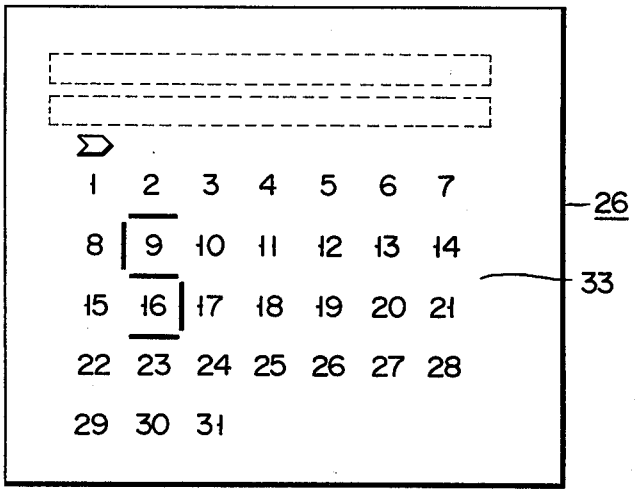
Figure 10:
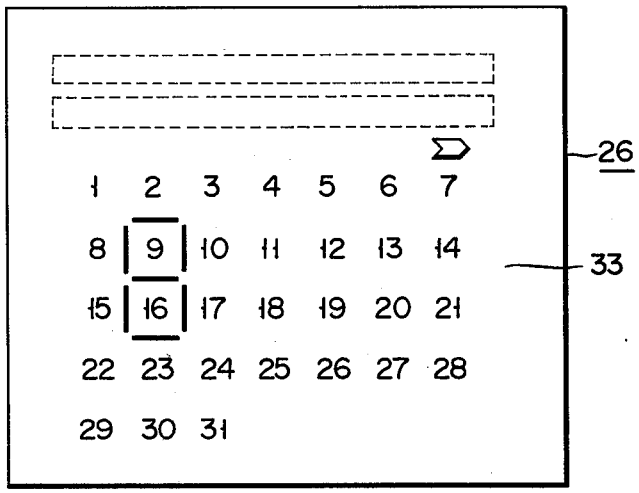
Figure 10:
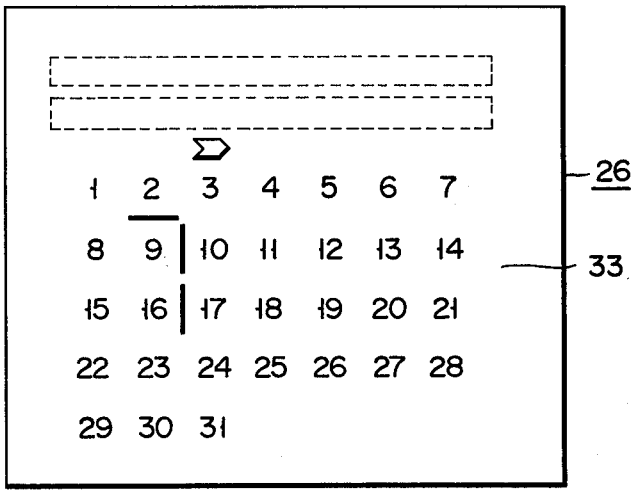

Where, with the switch $S_2$ thrown in, the switch $S_3$ is actuated, then the calendar table of the following month is displayed. FIGS. 9(*a*) and 9(*b*) respectively illustrate the calendar table of the current month, for example, April and the succeeding month or May. Where, with the switch $S_2$ thrown in, the switch $S_4$ is operated, then the calendar table of the preceding month is displayed. FIGS. 10(*a*) and 10(*b*) respectively indicate the calendar table of the current month, for example, August (8), and that of the preceding month or July (7).

The serial position of that column of the calendar table of a given month on which a particular day of the week, for example, "Sunday" falls was specified by the concurrent application of the "weekday" column specifying display means 35*a* to 35*g*. However, said column specification may be carried out by any other process, for example, that which flashes up the serial position of the "Sunday" column by the flickering of a light.

Where the operation of the switch $S_2$ is brought to an end after displaying the calendar table of the following or preceding month by the switch $S_3$ or $S_4$, then data on the serial position of the current month and data on the serial position of, for example, the "Sunday" column of the calendar table of the current month stored in the memories 45, 54 of FIG. 5 respectively are read out to the "month" counter 19 and "weekday" counter 21 respectively, thereby effecting time display as illustrated in FIG. 7. Where the switch $S_2$ is thrown in again, the calendar table of the current month is displayed once more. Thus, operation of the switch $S_3$ or $S_4$ temporarily displays the calendar table of the following or preceding month.

Where the calendar table of a month preceding or following the current month is displayed, the foregoing embodiment comprises the steps of judging the length of a longer or shorter month or February of a leap year, causing the "weekday" counter 21 to specify the serial position of that column of the calendar table of the preceding or succeeding month on which a particular day of the week, for example, "Sunday" falls; and thereafter varying the count made by the "month" counter 19 relative to the current month. However, it is possible first to decrease or increase the count already made by the "month" counter 19 relative to the current month to indicate the length of the preceding or succeeding month and then similarly change the count made by the "weekday" counter 21 relative to the serial position of that column of the current month on which a particular day of the week, for example, "Sunday" falls.

With the foregoing embodiment, where both switches $S_1$, $S_2$ ceased to be thrown in, "minute" and "hour" were displayed. Where the switch $S_2$ alone was actuated, the switching unit 22 issued a calendar table display instruction. However, it is possible to provide a binary flip-flop circuit whose output signal is reversed, each time, for example, the switch $S_2$ is operated and use an output signal from said binary flip-flop circuit as a calendar display instruction. Where the calendar table of the current month was displayed once more, after indicating the calendar table of the following or preceding month by actuating the switch $S_3$ or $S_4$ with the switch $S_2$ kept conducting, then the steps were taken of displaying "minute" and "hour" with the switch $S_2$ left open and thereafter again operating the switch $S_2$. However, it is possible to provide a separate switch and bring calendar data back to that of the current month by operation of said extra switch immediately after displaying the calendar table of the following or preceding month.

With the aforesaid embodiment, the calendar display apparatus was formed of a combination of a "weekday" display section and a "date"-"point of time" overlapping display section. Obviously, said calendar display apparatus may be so designed as to display a "weekday", "date" and "point of time" separately. Further, the calendar table used not indicate 1st to 31st days arranged in the form of 5 rows and 7 columns in conformity to the serial order of the seven days of the week. However, these days may be rearranged in 3 rows and 14 columns by grouping the days as "1 to 14", "15 to 28" and "29 to 31". The calendar table embodying this invention can be displayed, using the display panel of any other electronic appliance than a timepiece. Said calendar table can be incorporated in a small-scale electronic desk top calculator.

Figure 11:
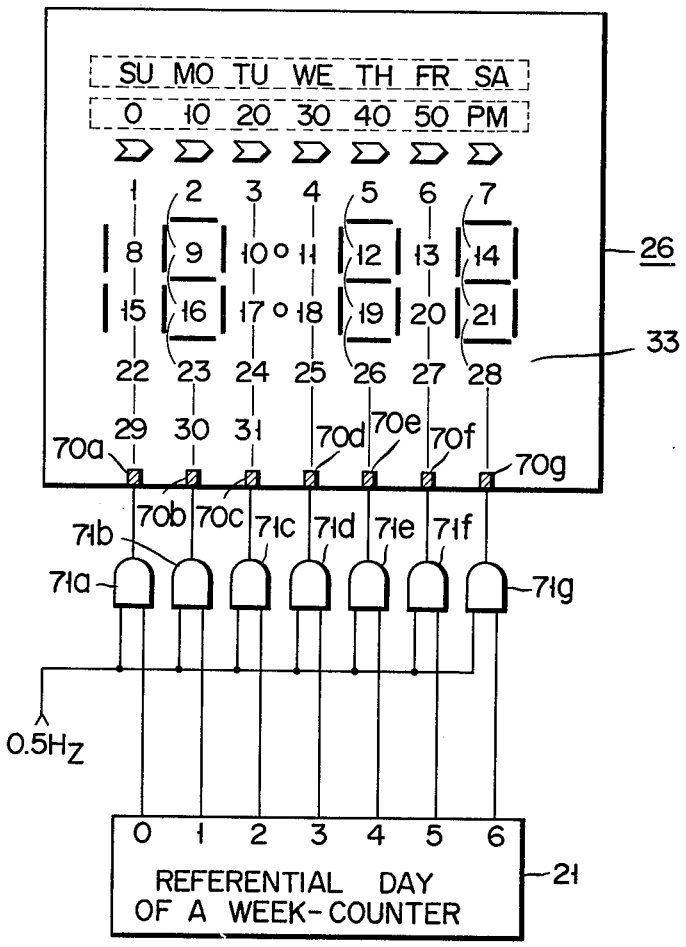
FIG. 11 is a circuit diagram of a control circuit supplying different control signals to the display panel, permitting the display panel to be operated in various display modes.

With the aforesaid embodiment, specification of that column of the calendar table on which a particular day of the week, for example, "Sunday" falls was carried out by the "weekday" column-specifying display means 35*a* to 35*g*. Obviously, the column of a "weekday", for example, "Sunday" can be displayed by any other means, for example, by the flickering of a light. It is possible to use, for example, light-flickering means wherein there are provided terminals 70*a* to 70*g* corresponding to the seven "weekday" colunns, as shown in FIG. 11, which receive output signals from AND circuits 71*a* to 71*g* supplied with counts of "0" to "6" made by the "weekday" counter 21, and rectangular waveform signals issued at such a frequency as 0.5 Hz, thereby causing, for example, the serial position of the "Sunday" column counted by the "weekday" column counter 21 to be flickered at an interval of 0.5 Hz frequency. The display means of the calendar display apparatus of this invention need not be formed of a liquid crystal, but may be constituted by any other means such as a light-emitting diode, electrophoresis and electrochromic.

What is claimed is:

1. A calendar display apparatus which comprises:

an electronic calendar display panel device (26) selectively indicating the 1st to 31st days constituting at least one month, said days being arranged at least in a plurality of columns in conformity to the serial order of the seven days of the week;

a source (11) of referential clock pulses;

data signal-generating means (17, 19) for producing, according to said referential clock pulses, at least date data and "month" data;

column data producing means (21) coupled to said data signal-generating means (17, 19) for producing column data corresponding to a column of a calendar table in which there falls a particular day of the week in the month indicated by the "month" data;

column-specifying means (35*a*–35*g*) for receiving the column data delivered from the column data producing means (21) and designating the column of the calendar table in which there falls said particular day of the week;

month-shift instruction-generating means ($S_2$, $S_3$, $S_4$) for shifting month data on the calendar forward or backward; and data-shifting means (51*a*–51*c*, 49*a*–49*c*) for changing a column data supplied to the column-specifying means (35*a*–35*g*) from the column data producing means (21).

2. The calendar display apparatus according to claim 1, wherein the calendar display panel device comprises seven column-specifying display means which are each supplied with column data from the column data producing means and are arranged in conformity to the serial order of the seven days of the week.

3. The calendar display apparatus according to claim 1, wherein the calendar display panel device comprises a plurality of display means for electronically indicating numerals denoting the 1st to 31st days.

4. The calendar display apparatus according to claim 1, wherein the calendar display panel device comprises a plurality of display units for electronically indicating numerals representing only the 29th, 30th and 31st days.

5. The calendar display apparatus according to claim 1, wherein the calendar display panel device further includes means for flickering display units designed to indicate the numerals denoting the days included in a selected day of the week column.

6. The calendar display apparatus according to claim 1, wherein the column data producing means further includes counting means whose count is shifted each time the month-shift instruction-generating means is operated.

7. The calendar display apparatus according to claim 1, wherein the calendar display apparatus further includes return means for bringing the changed column-specifying data back to that of the current month.

8. The calendar display apparatus according to claim 1, wherein said calendar display panel device includes a digital display means for digitally displaying the month.

9. The calendar display apparatus according to claim 1, wherein Sunday is the particular day of the week which falls on the column designated by said column-specifying means.

10. The calendar display apparatus according to claim 1, wherein said data signal-generating means counts at least "minute" data and "hour" data and is provided with a display means which selectively displays the "minute" and "hour" data or the calendar data.

11. The calendar display apparatus according to claim 1, wherein said days on said calendar display panel device are arranged in a plurality of rows and columns in conformity to the serial order of the seven days of the week.

* * * * *